United States Patent [19]

Saporiti et al.

[11] Patent Number: 4,976,021

[45] Date of Patent: Dec. 11, 1990

[54] FOUNDATION PROCESS FOR ASSEMBLING FURNITURE

[75] Inventors: Roberto Saporiti, Crenna Di Gallarate; Mauro Lipparini; Roberto Tapinassi, both of Florence, all of Italy

[73] Assignee: Saporiti Italia S.p.A., Besnare, Italy

[21] Appl. No.: 358,371

[22] PCT Filed: Aug. 31, 1988

[86] PCT No.: PCT/EP88/00779

§ 371 Date: May 1, 1989

§ 102(e) Date: May 1, 1989

[87] PCT Pub. No.: WO89/01748

PCT Pub. Date: Mar. 9, 1989

[30] Foreign Application Priority Data

Aug. 31, 1987 [IT] Italy ..... 83652 A/87
Aug. 31, 1987 [IT] Italy ..... 83653 A/87

[51] Int. Cl.[5] ..... B24B 39/00
[52] U.S. Cl. ..... 29/91.1
[58] Field of Search ..... 29/91.1, 91.4, 91

[56] References Cited

U.S. PATENT DOCUMENTS

| | | | |
|---|---|---|---|
| 543,218 | 7/1895 | Orr | 29/91.4 X |
| 2,802,297 | 8/1957 | Meyer | 29/91.1 X |
| 3,083,496 | 4/1963 | Feinerman | 29/91.1 |
| 3,896,531 | 7/1975 | Gorman | 29/91.1 |
| 3,972,098 | 8/1976 | Morrison et al. | 29/91.1 |

*Primary Examiner*—Timothy V. Eley
*Attorney, Agent, or Firm*—Gifford, Groh, Sprinkle, Patmore and Anderson

[57] ABSTRACT

A foundation process for assembling furniture in a stacking manner so as to create a variety of furniture designs. The foundation process utilizes a base, an elastic layer, and a number of uprights fitting into holes formed in the base and elastic layer. Seat cushions, an arm portion, and upper members are also added to create varied furniture designs. At least one box-like depression in the base houses a chariot and guide assembly which permits positionally varying placement of the uprights and upper members in order to further allow creation of novel furniture designs.

14 Claims, 4 Drawing Sheets

FIG.5
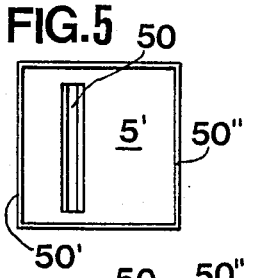
FIG.6
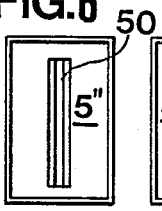
FIG.7
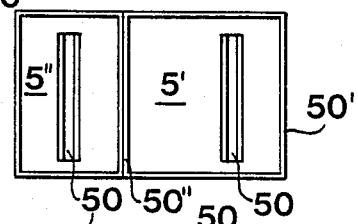
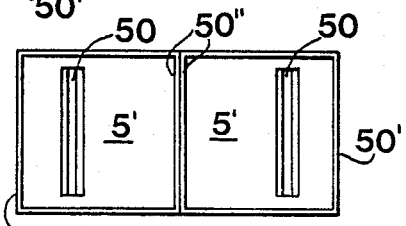
FIG.9
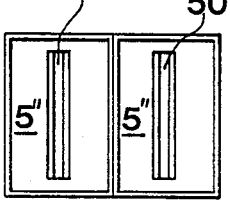
FIG.8
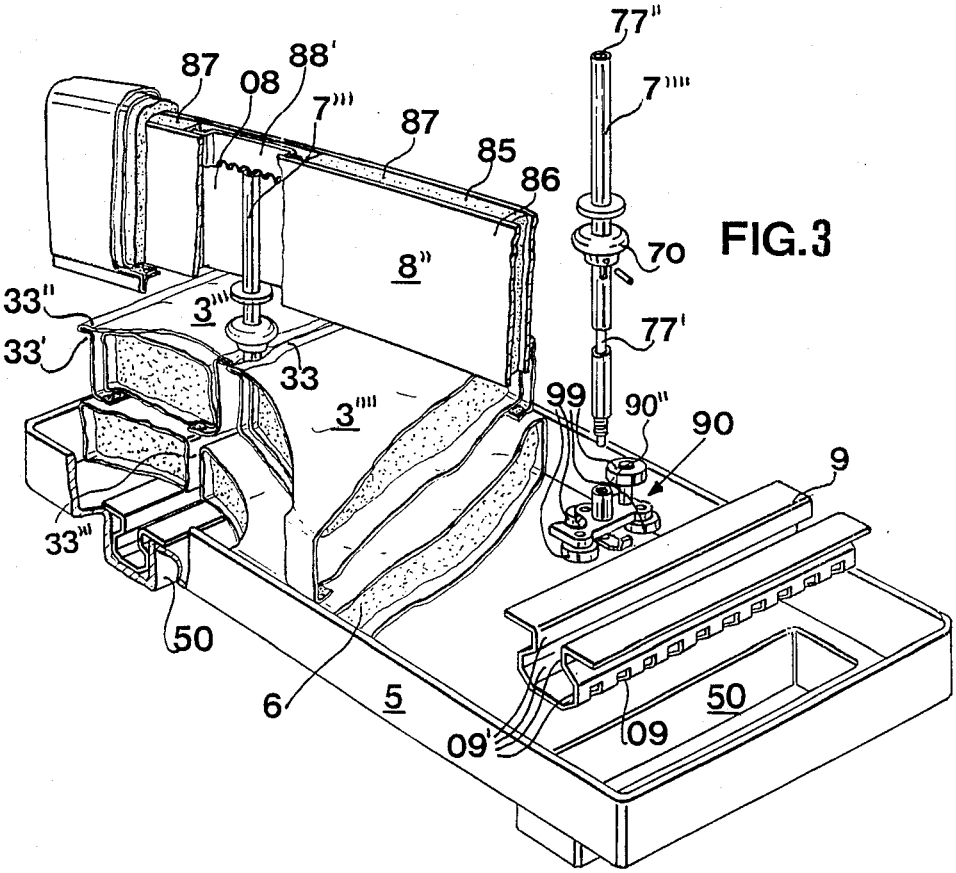
FIG.3

FOUNDATION PROCESS FOR ASSEMBLING FURNITURE

BACKGROUND OF THE INVENTION

1. Field of the Invention

The present invention relates to foundation process and means, for upholstered and/or cushioned furniture, wherein at least un upright or the like, erecting, from the base to pierce the padded and cushioned reclining place and providing a frame to the stringer and/or vertical members, may be itinerated, in a continuous or stepwise way, within the furniture plan. More particularly, the present invention relates to furniture obtained with such process and means.

2. Description of the Prior Art

In the present state of the art, furniture and particularly upholstered and/or cushioned furniture are manufactured in series and used, as manufactured, without any liberty for the user to modify it. Such liberty was limited to the choice of a particular upholstery or to place in any different way the pieces of furniture. This situation dictates numerous and frequent decisive and critical choices, destined to fall in crisis as soon as the the planned events change, i.e., in case of changes in family composition, in suit of rooms or use of same furniture in places different from those chosen. Another chance never considered was that to modify or arrange each piece of furniture to the power of circumstances of the particular moment. The till now devised arrangements were limited to move the seat and/or the back, according to a design strictly provided by the manufacturer, for a range of potential users or costumers, who could operate changes only if provided by the designer, but this did not affect the structure of upholstered and/or cushioned furniture as designed and made.

SUMMARY OF THE INVENTION

The invention, as claimed is intended to remedy these drawbacks. The inventors, with ingenious perception have conceived a foundation process and means, for upholstered and/or cushioned furniture such as chairs arm chairs divans, settees and the like, providing, according to a stepwise embodiment, a base, substantially in the form of plinth, including a series of seats, each adapted to receive at least an upright or the like, standing to pierce the padded and cushioned reclining place and providing a frame to the stringer and/or vertical members, such as the back, the arms and the like.

According to a preferred stepwise embodiment of the present invention, the base of the piece of furniture has conventionally consistency of substantially parallelepipedic housing and is provided with at least a member, extending horizontally, including, in a number of positions, distributed over at least an important section of the furniture plan, a number of seats in the form of dead vertical holes, having suitable shape, size and depth, to receive the bottom end of at least an upright or the like, standing to pierce the padded and/or cushioned reclining place and to provide a frame for the stringer and/or vertical members and/or frame members.

In accordance with a continuous itinerating embodiment of the present invention, itineration is dynamic, and is provided to uprights, comprising the frame, by at least a generally, but not exclusively, crosswise guide, for sliding at least a chariot, including at least a seat adapted to receive the bottom end of the upright, comprising the frame of the cushioned furniture. Of course, these devices are at least two for the back. In other words, instead of itinerating the uprights in fixedly distributed seats the same, at a base level, are made itinerant by placing each of them on a slidable chariot.

Some ways of carrying out the invention are described, in detail, below with reference to drawings which illustrate specific embodiments thereof, in which:

BRIEF DESCRIPTION OF THE DRAWINGS

FIG. 3 is a partially exploded and partially broken away perspective view, of a cushioned piece of furniture, in the form of a double place divan, comprising a flexible back, with two uprights, altogether in accordance with the present invention

FIG. 5 is a schematic plan view of a greater module suitable to provide the base of cushioned and/or upholstered furniture.

FIG. 6 is a schematic plan view of a smaller module suitable to provide the base for cushioned and/or upholstered furniture.

FIG. 7 is a schematic plan view of an assemblage including a greater module and a smaller module providing the base for cushioned and/or upholstered furniture.

FIG. 8 is a schematic plan view, of an assemblage including two smaller modules, providing a base for cushioned and/or upholstered furniture.

FIG. 9 is a schematic plan view, of two of the greatest modules providing a base for cushioned and/or upholstered furniture.

DESCRIPTION OF THE PREFERRED EMBODIMENTS

Figure 1:
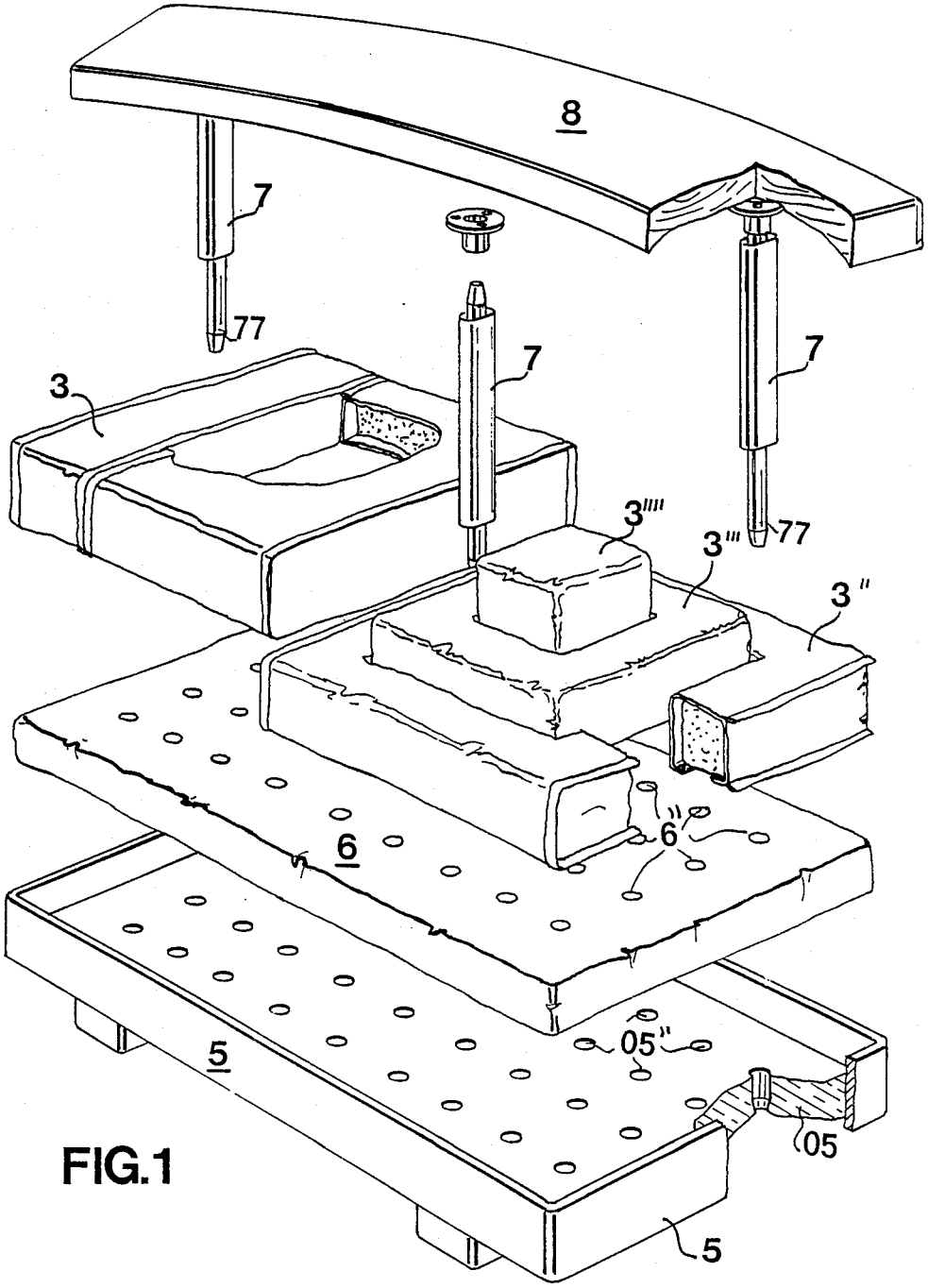
FIG. 1 is a perspective, completely exploded, view, of the members comprising a cushioned piece of furniture, in the form of a double place divan, including a rigid back, with three uprights, altogether in accordance with the present invention.

Referring now to the figures of the drawings, a cushioned piece of furniture, in the form of double place divan, comprises, conventionaly, a base 5, an elastic layer 6, uprights 7, 7', 7'', 7''', 7'''' upper members 8, 8', 08' 08'', 8'', an arm 4 and seat cushions 3, 3', 3'', 3''', 3''''. Conventionally, said members are assembled substantially by locking them together or with arrangement for moving some of them.

The base 5, is conventionally comprised by a substantially parallelepipedic housing, it includes at least two modular members 5' and/or 5'' (FIGS. from 5 to 9). In fact, the modular members are of two kinds: the larger module 5' and the smaller module 5''. Members 5' and 5'' includes each a substantially parallelepipedic depression or box 50, projecting downwardly from the bottom to provide a bearing on the floor, not shown, for the piece of furniture. Such depression 50, in the larger modular member 5', is provided transversely to the longitudinal direction of use (FIGS. 6 and 7). Moreover, such depression or box 50 in the same modular member 5', is closer to side 50' than to the opposite side 50″. Whereas, the depression 50 in the smaller member 5″ is placed exactly in the middle.

In accordance with a stepwise embodiment (FIGS. 1 and 2) of the present invention the base 5, having conventionally consistency of a substantially parallelpipedic housing, is provided with at least a member, i.e. the bottom 05, extending horizontally, including in a number of positions, distributed over at least an important section of the furniture plan, a number of seats in the form of base holes 05″, having suitable shape, size and depth, to receive the ends 77 of said uprights 7, 7′, 7″ and to keep them locked in place. The elastic padding member 6, made of elastic, deformable foamed plastic resin is provided with passages or holes 6″, corresponding to at least to a number of holes 05″ of below member 5′ such passages or holes 6″, receive therethrough the uprights 7, 7′, 7″, 7‴, 7⁗ directed downward to meet and join with seats 5″ and upwardly to provide a support and a frame for the stringer and/or vertical members such as the backs 8, 8′, 8″, 08′, 08″ and the arm 4. Correspondingly cushions 3, 3′, 3″, 3‴, and 3⁗, providing the reclining place are shaped and/or arranged so as to leave therebetwee, i.e., at 33 or inside, i.e., at 33′ and 33″, passaways for uprights 7, 7′, 7″, 7‴, 7⁗.

Assemblage of upper members 8, 8′, 8″, 08′, 08″ to uprights 7, 7′, 7″, 7‴, 7⁗ may be provided in several ways. Member 8 providing the back, may be rigid and be provided with three uprights 7, fastened thereto according to a fixed pitch; in this case the position of back 8 chosen among that of the holes, 05″ having the same pitch of uprights 7 fixedly mounted on the same back 8. Alternatively the connection between the same back 8 and upright 7 may be adjusted in a range, not shown, depending from distribution density of the holes 05″ in the base. Member 4, comprising the arm, may be provided with a single upright 07 fastened thereto. In this case, there is no pitch problem and the upright 07 may be placed substantially in any place of the plan of cushioned piece of furniture. Upper member 8′, in turn, may be provided with several seats 80′, adapted to receive upright 7′ and may be rigid or flexible, at least in the horizontal attitude. According to a preferred embodiment of the present invention. The upper members 8′ may comprise a battery of parallel pipes 88, arranged as organ pipes, at least a few of them being in a position to receive the uprights 7′ which of course have the task to frame the upper members 8′, 08′ which, in itself, is substantially soft, at least in the direction perpendicular to the length of pipes 88 comprising the upper members 8′, 08′.

From the description given herein the operation of the process should be self explaining however a brief description will be given hereafter regarding upper members 08′, 08″, which are alternative to upper members 8, 8′ and 8″. It is self explaining as assembling together, in several combinations, such members, a number of different furniture styles can be provided. Moreover, such combinations can be, at any time changed, arranged or adapted according to any preference or need.

In accordance with a dynamic preferred form of the present invention, the larger member 5′ has a plan size of cm 80×95 and the smaller member 5″ has a plan size of cm 30×cm 95.

Figure 4:
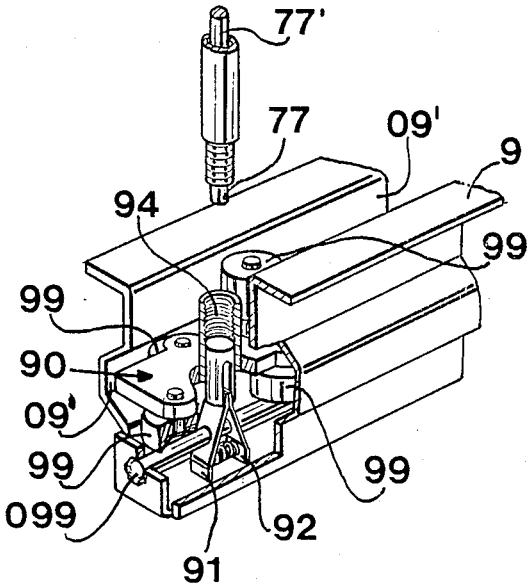
FIG. 4 is a detailed perspective view, in an enlarged scale with respect to FIG. 1, of an embodiment of the locking device.

Within the hollow of depression or box 50 is mounted a guide 9 with a chariot 90 slidably mounted thereon. In accordance with a preferred embodiment of the present invention, the guide 9 for sliding of chariot 90, wherein said guide 9 is substantially laminar with constant thickness and in the form of a polygonal inverted "omega" in cross section, wherein the four vertical guide walls 09′, placed on two levels, are engaged by four ball bearings 99′ or the like. To lock the chariot 90 to guide 9 two arrangements are included. In one case (FIG. 3), the cooperation of a tooth 99″ with notches (09″), is provided; while in another case (FIG. 4), the cooperation of stop plates 91 and 92, separated by spring 93, with a rod 099 are provided, wherein the locking devices are compacted in order to be contained in support 94 of chariot 90 and to be operable, in both directions, by the bottom end 77, of a slidable rod 77′ within the tubular upright 7, and having in the middle an annular projection 70 which is insertable by sliding it vertically, and wherein the upper end 77″ of rod 77′ is tubular and cooperates with a rack 88′, to be described later, in concert with the sole control to be given to annular member 70.

The elastic padding member 6 (FIG. 3), is suitably made of deformable elastic foamed plastic material and is provided therethrough with passageways 33‴, at least corresponding to at least some paths followed by chariot 90 or grooves, providing the passage therethrough in both directions of uprights 7‴, 7⁗ directed downward to meet and couple with the seats 90″ and upwardly to provide a support and a frame for the stringer and/or vertical members, not shown. In turn, the cushions 3, 3′, providing the reclining place, are shaped and/or sized and/or distributed in order to leave between them i.e., at 33 or in their body, free passageways 33′ for the uprights.7‴, 7⁗, directed downwardly to meet the passageways 33‴ and the seats 90′ and upwardly to provide a frame, for the stringer and/or vertical members, such as the upper members 8, 8′, 8″, 08′, the arm 4 and the like. Said passageways 33′ are provided in the upper side with covering flanges 33″ which extend outwardly to hide the passage grooves 33 for uprights 7, 7′, 7″, 7‴, 7⁗.

Figure 2:
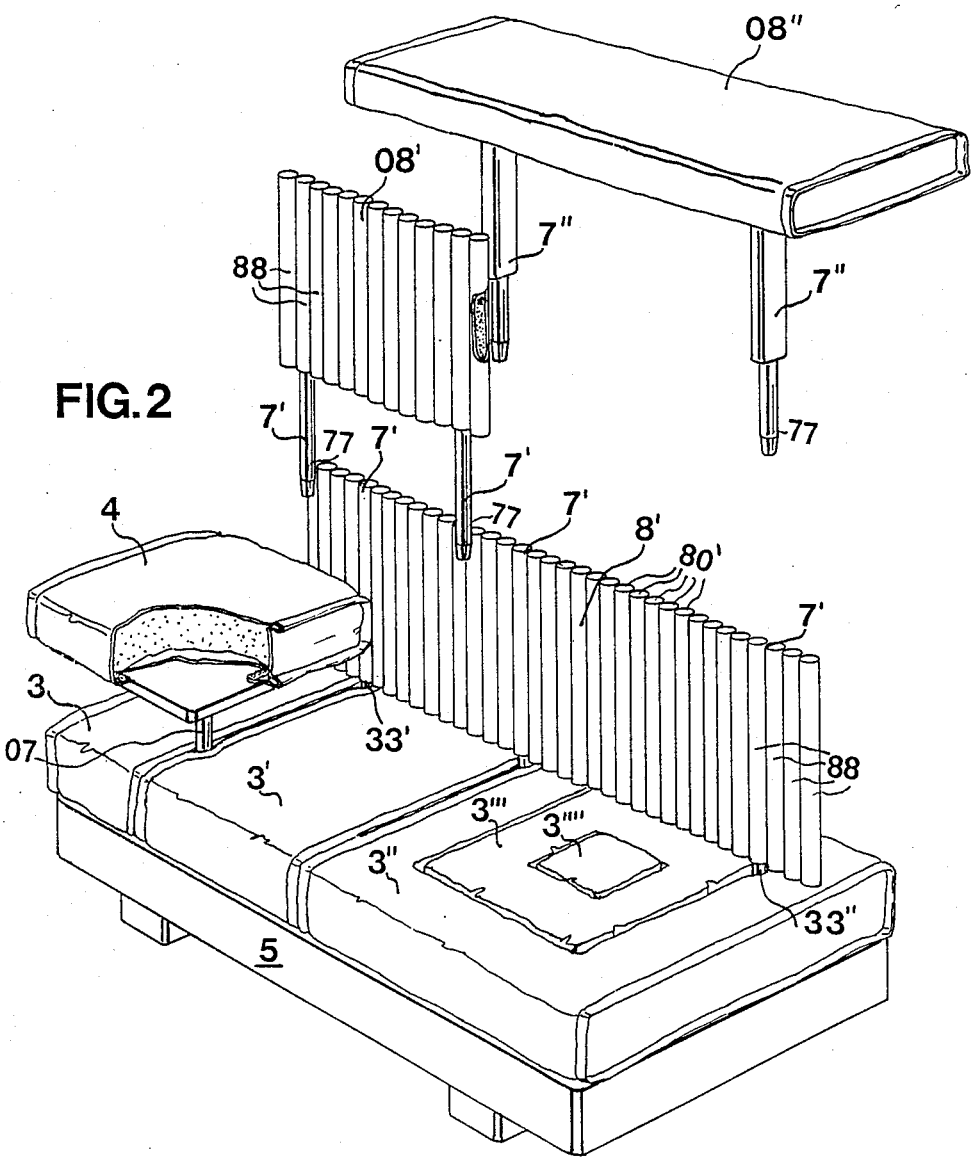
FIG. 2 is a perspective view, of another cushioned piece of furniture, in accordance with the present invention which is assembled and having two exploded members

As in the embodiment of FIGS. 1 and 2, the assemblage of upper members to uprights may be provided in several ways. Upper member 8″, providing a back, may be rigid and comprise three uprights 7, fastened thereto according to a fixed pitch. Alternatively the connection between the same upper member 8″ and uprights 7 may be adjusted in a range e.g., that permitted by the hollow space 08.

Upper member 8′, providing the back, in turn, may include several seats 08, to receive the upper end of uprights 7.

Upper member 8′ providing the back of FIG. 3 includes at least a sandwich of two sheets 85, 86 made of glass reinforced plastic or the like with pads 87 of foamed resin, providing the hollows 08. It results in a deformable, strong and elastic, panel to permit mutual shifting of sheets 85 and 86 and thus the flexibility of the unit or back 8″.

It will be appreciated that the foundation process and means, for upholstered and/or cushioned furniture, wherein at least an upright 7, 7′, 7″, 7‴, 7⁗ or the like erecting, from the base 5 to pierce the elastic layer 6 and cushioned reclining place 3 and providing a frame to the stringer and/or vertical upper members 8, 8′, 8″, 08′, 08″, may be itinerated, in a continuous (FIGS. 3 and 4) or stepwise (FIGS. 1 and 2) way, within the furniture plan provide an arrangement through which the same user in any time during the furniture life can modify even thoroughly the attitude of movable parts obtaining particular practice and aesthetic results.

We claim:

1. A foundation process for assembling furniture, which comprises:

forming a plurality of holes through a base and an elastic layer;

placing said elastic layer atop said base in such a manner as to align the said holes;

placing an arm portion and at least one cushion atop the elastic layer; and inserting at least one upright vertically through said holes of said base and elastic layer.

2. The invention as described in claim 1, comprising in addition an upper member attachable to said uprights so as to form a furniture back.

3. The invention as described in claim 2, wherein said upper member is configured as a substantially horizontal furniture back.

4. The invention as described in claim 2, wherein said upper member is configurated as a substantially vertical back.

5. The invention as described in claim 4, wherein the said vertical configuration of said upper member is constructed of glass reinforced plastic and foamed resin pads so as to enhance material strength and elasticity.

6. The invention as described in claim 1, wherein said arm is supported by one of said uprights.

7. The invention as described in claim 1, wherein said upper members may take the form of a battery a parallel pipes, a few of said pipes receiving said uprights.

8. The invention as described in claim 8, comprising in addition at least one box-like depression formed within said base, said depression further having a modular member contained therein.

9. The invention as described in claim 8, wherein said modular member further comprises a guide with a chariot slidably mounted therein, said chariot receiving the bottom end of said upright via a slidable rod connected to said chariot.

10. The invention of claim 9, wherein said chariot is slidably movable along said guide of said modular member in such a manner as to vary placement of said upper member.

11. The invention of claim 9, wherein said chariot further comprises ball bearings engaging vertical guide walls of said guide.

12. The invention of claim 9, wherein said chariot is locked to said guide by means of a tooth mounted on said chariot engaging notches formed within said guide.

13. The invention of claim 9, wherein said chariot is locked to said guide by a pair of stop plates and a spring, said stop plates and spring contained within a support of said chariot, said chariot further receiving therethrough a rod extending the length of said guide.

14. The invention of claim 9, comprising in addition passageways formed within said elastic layer, said passageways corresponding to the motions of said chariot, said passageways further having covering flanges to hide said passageways.

* * * * *